United States Patent [19]

Work

[11] 4,288,952

[45] Sep. 15, 1981

[54] BURIAL VAULTS

[75] Inventor: Gerald L. Work, Spokane, Wash.

[73] Assignee: Wilbert, Inc., Forest Park, Ill.

[21] Appl. No.: 97,716

[22] Filed: Nov. 27, 1979

[51] Int. Cl.[3] ..... E04H 13/00

[52] U.S. Cl. ..... 52/138; 27/35; 52/140

[58] Field of Search ..... 52/138–141; 27/35

[56] References Cited

U.S. PATENT DOCUMENTS

| | | | |
|---|---|---|---|
| 507,763 | 10/1893 | Smucker | 52/138 X |
| 809,897 | 1/1906 | Bending | 52/138 |
| 1,124,065 | 1/1915 | Savidge | 52/140 X |
| 1,837,402 | 12/1931 | Broughton | 52/138 X |
| 2,038,300 | 4/1936 | Kuettner | 52/138 |
| 2,247,617 | 7/1941 | Metz | 52/141 X |
| 2,880,492 | 4/1959 | Johnson | 52/138 |
| 3,208,186 | 9/1965 | Fulton et al. | 52/140 |
| 3,208,188 | 9/1965 | Fulton et al. | 52/138 |
| 3,868,799 | 3/1975 | Hayward | 52/138 X |
| 4,154,031 | 5/1979 | Williamson | 52/138 X |

FOREIGN PATENT DOCUMENTS

| | | | |
|---|---|---|---|
| 984774 | 2/1951 | France | 52/141 |

*Primary Examiner*—J. Karl Bell

*Attorney, Agent, or Firm*—Charles B. Cannon

[57] ABSTRACT

A burial vault is provided, the component parts of which are preferably made of molded plastic resinous material, such as polyethylene, and which comprises a composite base including as components parts thereof, (1) a generally flat, rectangular-shaped supporting platform; (2) an inner upright wall structure including a generally rectangular-shaped frame mounted on the said supporting platform member and having an open top and having a lower end portion which is mechanically fastened and hermetically sealed to the supporting platform and having upstanding side walls and end walls which are provided on their outer surfaces with laterally spaced generally vertically extending parallel reinforcing ribs; and (3) a generally flat rectangular-shaped top closure plate or lid member which is arranged over and closes the open top of the frame member of the inner upright wall structure and is hermetically sealed thereto. The burial vault includes a dome-shaped outer cover member having side walls and end walls, a closed top wall and an open bottom wall; the dome-shaped outer cover member being arranged over the top closure plate or lid member and being arranged over and enclosing the frame of the inner upright wall structure and being mechanically fastened and hermetically sealed to the supporting platform member.

16 Claims, 9 Drawing Figures

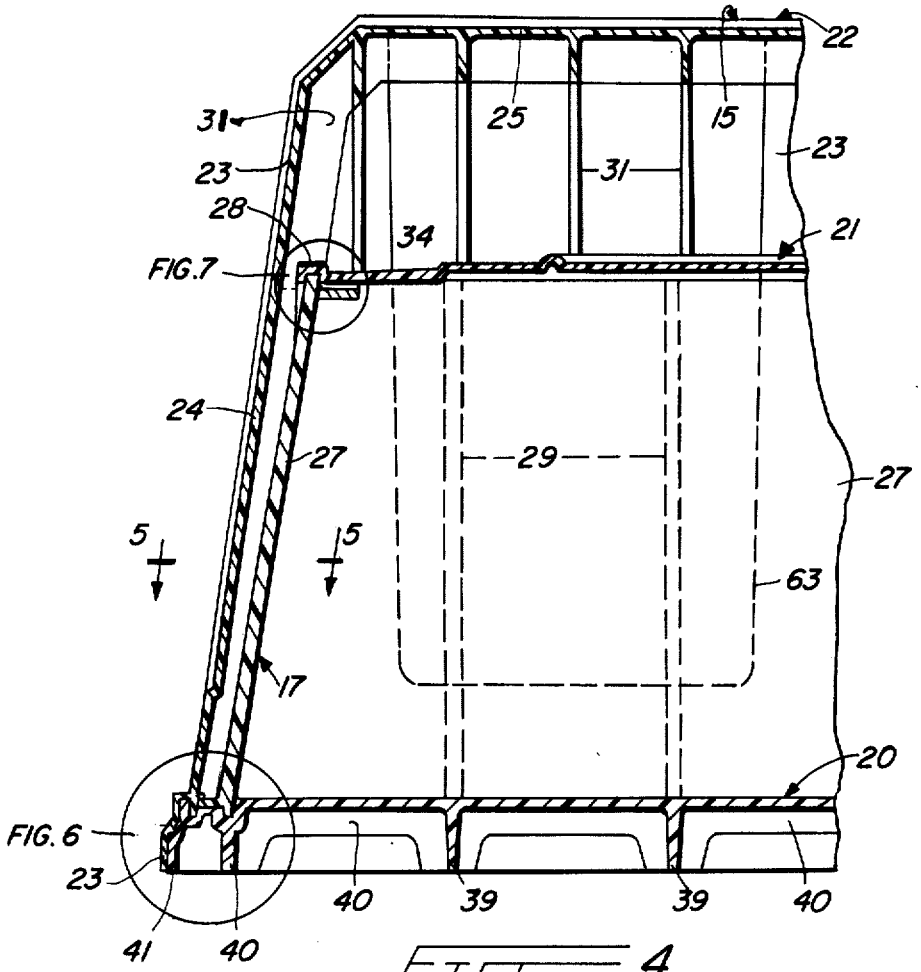
FIG. 4
FIG. 8
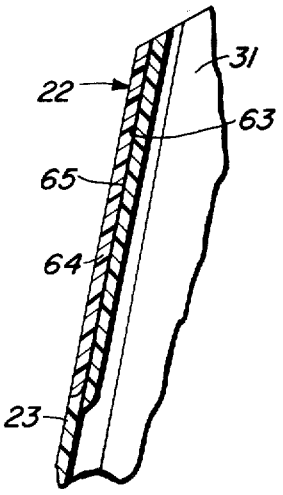
FIG. 9
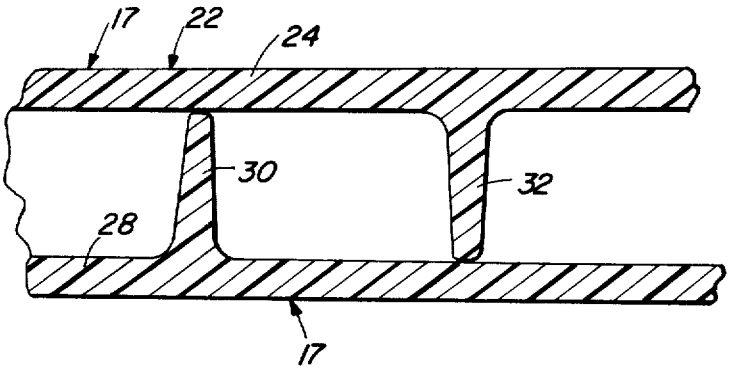

BURIAL VAULTS

BACKGROUND OF THE INVENTION

Molded plastic resinous burial vaults have been known heretofore and the prior art of such vaults is believed to be fairly represented by U.S. Pat. Nos. 3,208,186 and 3,208,188 and by certain of the references cited therein. However, such molded plastic resinous burial vaults have, in many instances, not been entirely satisfactory due, in some instances, to lack of adequate structural strength, lack of proper hermetic sealing and water-resistance, lack of adequate aesthetic appearance, and other deficiencies.

OBJECTS OF THE INVENTION

An object of the present invention is to provide a new and improved molded plastic resinous burial vault which comprises a composite base including as components thereof (1) a generally flat, rectangular-shaped supporting platform; (2) an inner upright wall structure mounted on the said supporting platform and including a generally rectangular-shaped frame having an open top and having a lower end portion which is mechanically fastened and hermetically sealed to the said supporting platform and having upstanding side walls and end walls which are provided on their outer surfaces with laterally spaced generally vertically extending parallel reinforcing ribs; and (3) a generally flat, rectangular-shaped top closure plate or lid member which is arranged over and closes the open top of the said inner upright wall structure and is secured and hermetically sealed thereto; the new burial vault including an outer dome-shaped cover member having side walls and end walls; a closed top wall; and an open bottom wall; the dome-shaped outer cover member being arranged over the said top closure plate or lid member and being arranged over and enclosing the said inner upright wall structure and being mechanically fastened and hermetically sealed to the said supporting platform; the dome-shaped outer cover member having on the inner surfaces of the said side walls and end walls thereof laterally spaced generally parallel reinforcing ribs which cooperate with the reinforcing ribs on the outer surfaces of the side walls and end walls of the generally rectangular-shaped frame of the said inner upright wall structure to enhance the structural strength of the assembled burial vault; and the dome-shaped outer cover member having geometrically shaped recesses in the outer surfaces of the side walls and end walls thereof in which correspondingly geometrically shaped decorative colored panels are adhesively mounted.

Another object of the invention is to provide a new and improved molded plastic resinous burial vault which is (1) water-resistant; (2) has high structural strength and resistance to the crushing forces of the overlying earth when in the grave opening and to the weight of cemetery machinery moving thereover; (3) has high resistance to the hydrostatic pressure of the ground water when in the grave opening; (4) and has a desirable aesthetic appearance and appeal.

Another object of the invention is to provide in the new molded plastic resinous burial vault novel means and constructions for mechanically fastening and hermetically sealing the lower end portion of the generally rectangular-shaped frame of the inner upright wall structure to the supporting platform.

An additional object of the invention is to provide in the new burial vault novel means and constructions for mechanically fastening and hermetically sealing the dome-shaped outer cover member to the supporting platform.

A further object of the invention is to provide in the new burial vault a novel means and construction for mounting the dome-shaped outer cover member on the closure plate or lid member.

An additional object of the invention is to provide in the new burial vault novel means and constructions for mechanically securing and hermetically sealing the closure plate or lid member to the generally rectangular-shaped frame of the inner upright wall structure.

An additional object of the invention is to provide a molded plastic resinous burial vault which is designed and adapted for use both as a part of a casket and as a burial vault in the funeral and burial vault method or system which is disclosed and claimed in applicant's copending application, Ser. No. 109,346 filed Jan. 3, 1980 now U.S. Pat. No. 4,249,289 and entitled Combination Burial Vault and Casket and Funeral and Burial Method or System.

Other objects will appear hereinafter.

DESCRIPTION OF FIGURES IN THE DRAWINGS

FIG. 4 is an enlarged fragmentary transverse vertical sectional view, on line 4—4 in FIG. 3, showing certain of the component parts of the new burial vault in assembled position;

Figure 1:
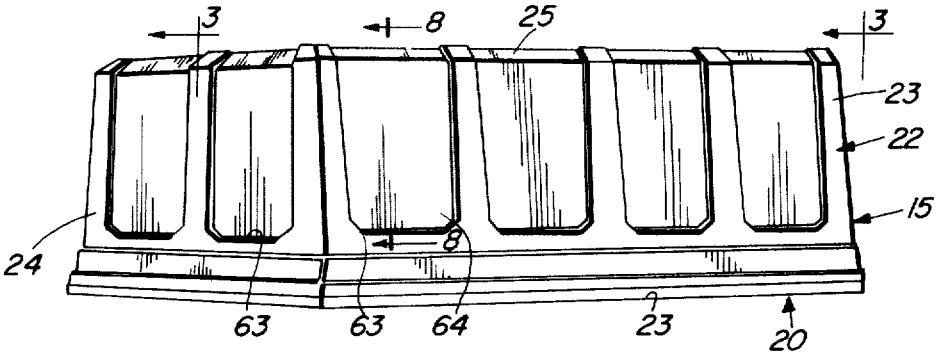
FIG. 1 is a perspective view of the new burial vault with the component parts thereof in assembled position.
Figure 3:
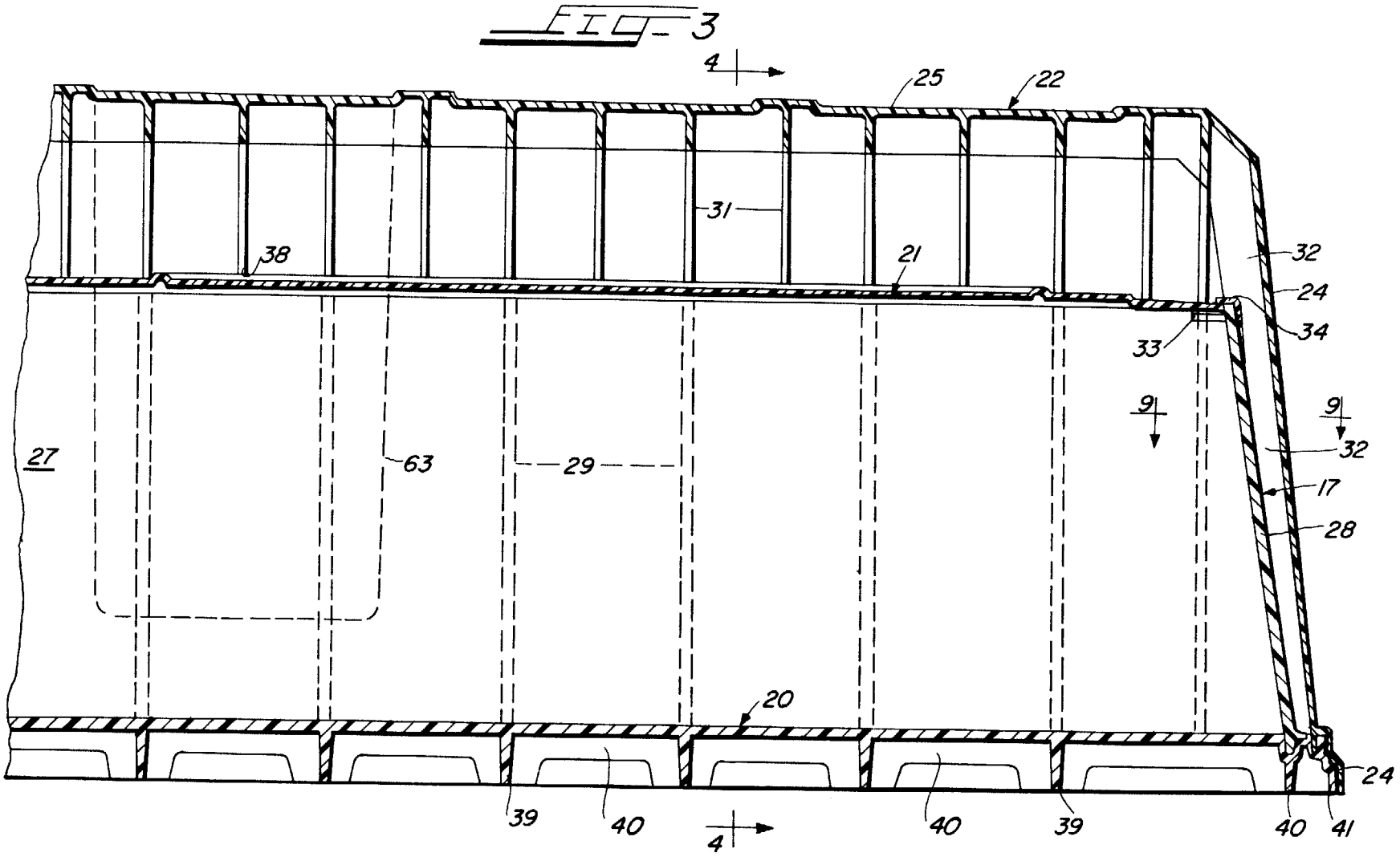
FIG. 3 is an enlarged fragmentary vertical and longitudinally extending sectional view, on line 3—3 in FIG. 1, showing certain of the component parts of the new burial vault in assembled position.
Figure 6:
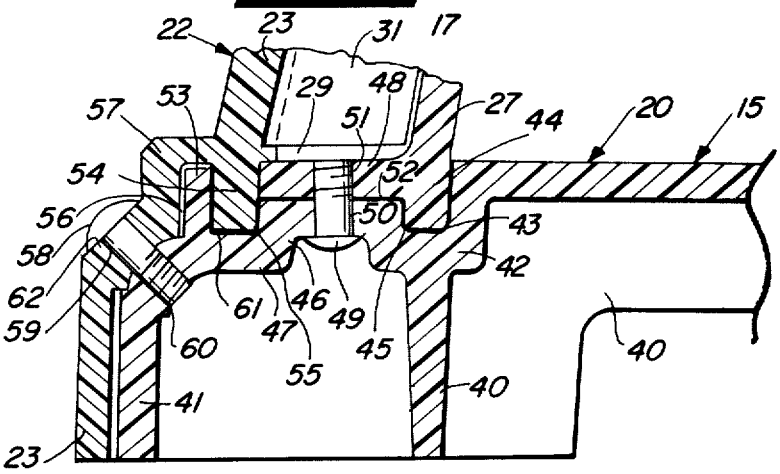
Figure 7:
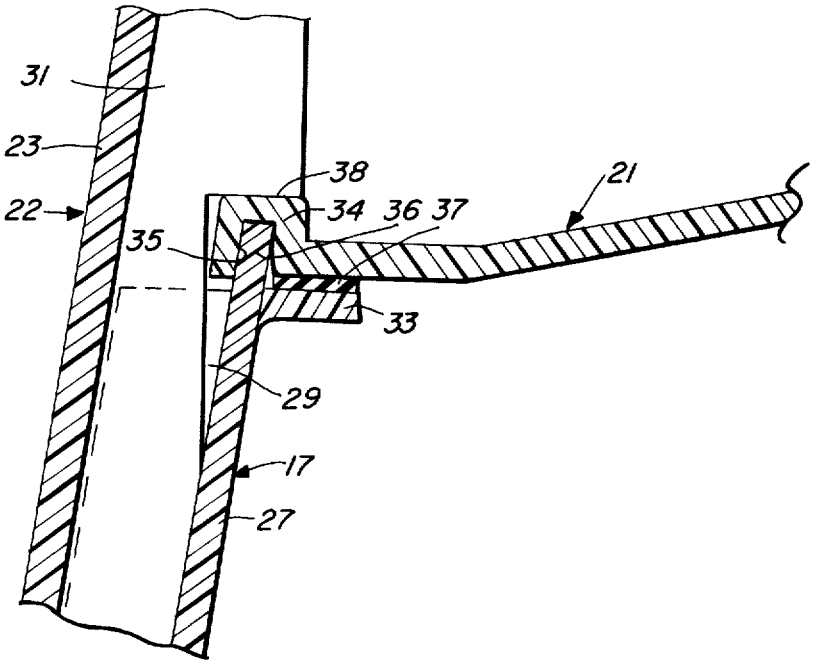

FIG. 6 is an enlarged fragmentary sectional detail view of the area encircled in FIG. 4, illustrating the means or construction for mechanically fastening and hermetically sealing the dome-shaped outer cover member to the supporting platform, and also showing the means or construction for mechanically fastening and hermetically sealing the generally rectangular-shaped frame of the inner upright wall structure to the supporting platform;

FIG. 7 is an enlarged fragmentary sectional detail view of the area encircled in FIG. 4, illustrating the means or construction for securing the closure plate or lid member to the generally rectangular-shaped frame of the inner upright wall structure and the means or construction for hermetically sealing the closure plate or lid member to the frame of the inner upright wall structure;

FIG. 8 is an enlarged fragmentary vertical sectional view, on line 8—8 in FIG. 1, illustrating the arrangement and adhesive mounting of one of the decorative colored geometrically-shaped inserts or panels in one of the correspondingly geometrically-shaped recesses or panel areas in the outer surface of the side walls of the dome-shaped outer cover member; and FIG. 9 is an enlarged sectional detail view on line 9—9 in FIG. 3 illustrating the arrangement of the reinforcing ribs on the outer surface of the end walls of the generally rectangular-shaped frame of the inner upright wall structure and the reinforcing ribs on the inner surfaces of the end walls of the dome-shaped outer cover member.

DETAILED DESCRIPTION OF THE NEW BURIAL VAULT ILLUSTRATED IN THE DRAWINGS

Figure 2:
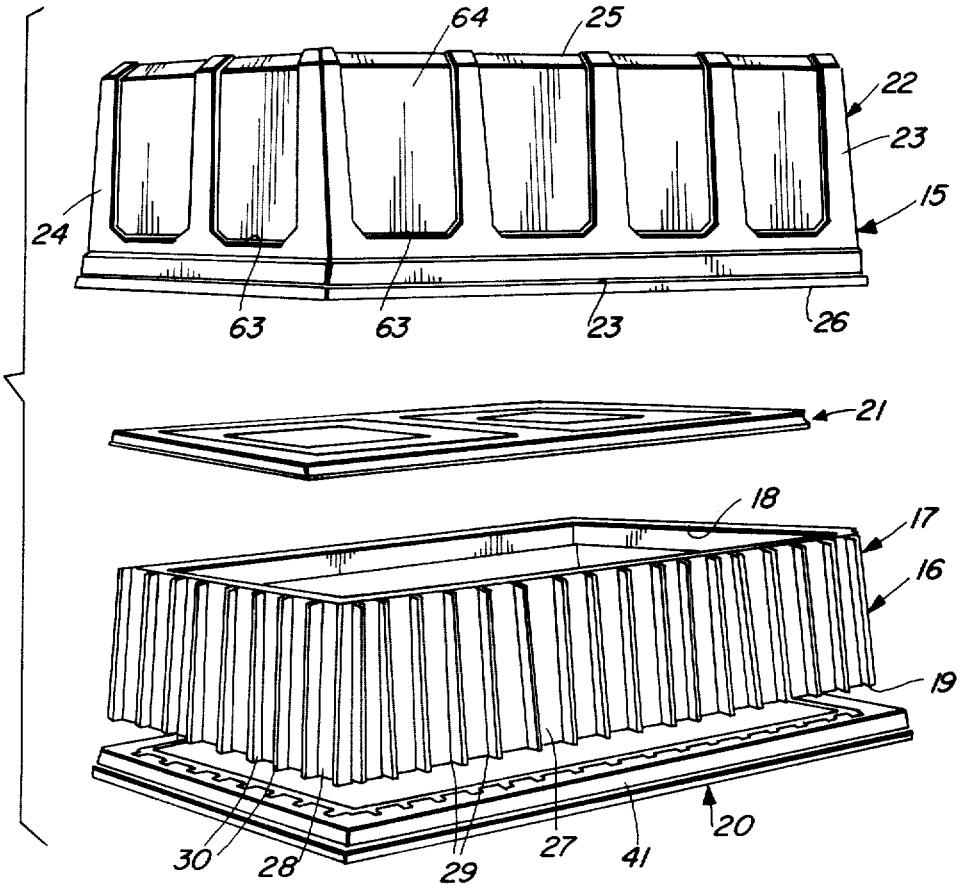
FIG. 2 is an exploded perspective view of the component parts of the new burial vault.

A typical and preferred embodiment of the new burial vault is illustrated in the drawings, wherein it is generally indicated at 15, and is shown with the component parts thereof in assembled position in FIG. 1, and with the component parts thereof shown separately in the exploded view, FIG. 2.

As shown in FIG. 2, the new burial vault 15 includes a composite base 16 which is composed of three component parts, namely, (1) an inner upright wall structure 17 having a generally rectangular-shaped frame which has an open top 18; an open bottom 19; generally vertically extending side walls 27 and end walls 28; (2) a generally rectangular-shaped supporting platform on which the generally rectangular-shaped frame of the inner upright wall structure 17 is supported when the parts are in assembled position, as in FIGS. 1, 3, 4 and 6; and (3) a generally rectangular-shaped flat closure plate or lid member 21 which is arranged over and closes the open top 18 of the generally rectangular-shaped frame of the inner upright wall structure 17 when the parts are in assembled position, as in FIGS. 1, 3, 4 and 7.

The new burial vault 15 also includes a dome-shaped outer cover member which is generally indicated at 22, and which is generally rectangular-shaped in form, and includes side walls 23; end walls 24; a closed and generally flat top wall 25; and an open bottom 26.

All of the four major component parts 17, 20, 21 and 22 of the new burial vault 15 are preferably molded from suitable synthetic plastic molding material such, for example, as polyethylene resin, or other suitable molding resin.

As best shown in FIG. 2, the side walls 27 and end walls 28 of the generally rectangular-shaped frame of the inner upright wall structure 17 have generally parallel and generally vertically extending spaced reinforcing ribs 29 and 30, respectively, formed integrally therewith on the outer surfaces thereof.

Similarly, each of the side walls 23 and end walls 24 of the dome-shaped outer cover member 22 has a series of generally vertically extending parallel spaced reinforcing ribs 31 and 32, respectively, formed integrally therewith on their inner surfaces (FIGS. 3, 4, 5 and 9).

Figure 5:
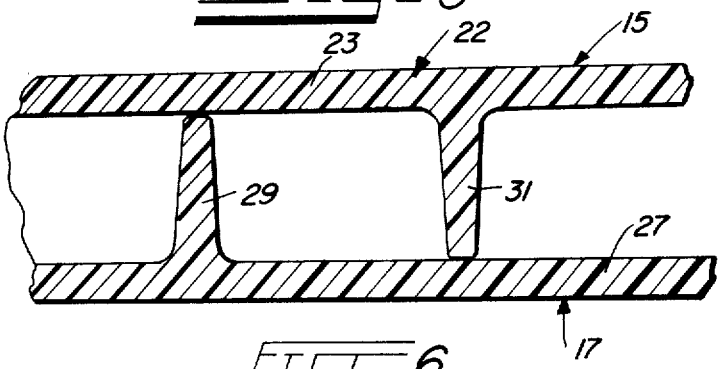
FIG. 5 is an enlarged fragmentary transverse sectional plan view, on line 5—5 in FIG. 4, illustrating the construction and arrangement of the reinforcing ribs on the outer surfaces of the side walls of the generally rectangular-shaped frame of the inner upright wall structure and the reinforcing ribs on the inner surfaces of the side walls of the dome-shaped outer cover member.

As shown in FIG. 5, the reinforcing ribs 29 on the outer surfaces of the side walls 27 of the generally rectangular-shaped frame of the inner upright wall structure 17 engage the inner surfaces of the side walls 23 of the dome-shaped outer cover member 22 and, similarly, the reinforcing ribs 31 on the inner surfaces of the side walls 23 of the dome-shaped outer cover member 22 engage the outer surfaces of the side walls 27 of the frame of the inner upright wall structure 17. Similarly, as shown in FIG. 9, the reinforcing ribs 30 on the outer surfaces of the end walls 28 of the frame of the inner upright wall structure 17 engage the inner surfaces of the end walls 24 of the dome-shaped outer cover member 22 and the reinforcing ribs 32 on the inner surfaces of the end walls 24 of the dome-shaped outer cover member 22 engage the outer surfaces of the end walls 28 of the frame of the inner upright wall structure 17. This arrangement of the reinforcing ribs 29, 30, 31 and 32, in relation to the frame of the inner upright wall structure 17 and the dome-shaped outer cover member 22, greatly enhances the structural strength of these parts and of the burial vault 15, in general, when the parts thereof are in assembled position.

THE MEANS FOR HERMETICALLY SEALING AND MECHANICALLY SECURING THE CLOSURE PLATE OR LID MEMBER 21 TO THE GENERALLY RECTANGULAR-SHAPED FRAME OF THE INNER UPRIGHT WALL STRUCTURE 17 (FIG. 7)

As shown in FIGS. 3 and 7 of the drawings, the side walls 27 and end walls 28 of the generally rectangular-shaped frame of the inner upright wall structure 17 have a marginal or peripheral supporting flange 33 formed integrally therewith on the upper end portions thereof and this supporting flange 33 projects laterally and generally horizontally inwardly from the side walls 27 and end walls 28 of the frame of the inner upright wall structure 17.

As also best shown in FIGS. 3 and 7, the generally rectangular-shaped closure plate or lid member 21 has an upwardly extending and generally inverted U-shaped marginal or peripheral flange member 34 formed integrally therewith, and extending around its marginal or peripheral edges, and a downwardly facing groove 35 is formed in the inverted U-shaped flange member 34. The upper marginal edge portions, as 36, of the side walls 27 and end walls 28 of the frame of the inner upright wall structure 17 extend into the groove 35, thus providing a tongue and groove supporting construction 34–35–36 between the upper marginal edge portions, as 36, of the side walls 27 and end walls 28 of the frame of the inner upright wall structure 17 and the generally rectangular-shaped closure plate or lid member 21, so that the closure plate or lid member 21 rests on and is secured by the upper marginal edge portions, as 36, of the side walls 27 and end walls 28 of the inner upright wall structure 17, as shown in FIGS. 3 and 7.

As is also shown in FIG. 7, a layer of suitable and conventional plastic sealant material 37 is arranged upon and over the upper surface of the inwardly extending marginal or peripheral flange 33 and the outer marginal or peripheral edge portions of the closure plate or lid member 21 rest on the layer 37 of plastic sealant material 37, thereby providing an hermetic water-resistant seal between the frame of the inner upright wall structure 17 and the closure plate or lid member 21 when the parts are in assembled position, as in FIGS. 1, 3, 4, 6 and 7.

As is likewise shown in FIGS. 3 and 7, each of the internal reinforcing ribs 31 and 32 on the inner surfaces of the side walls 23 and end walls 24, respectively, of the dome-shaped outer cover member 22 includes an upper portion having a notched section which provides a generally horizontally extending shoulder 38 formed therein in the upper areas thereof, and in the assembly of the component parts of the new burial vault 15 these shoulders 38 rest on the upper surface of the marginal or peripheral flange 34 of the closure plate or lid member 21.

THE MEANS FOR HERMETICALLY SEALING AND THE MEANS FOR MECHANICALLY FASTENING THE GENERALLY RECTANGULAR-SHAPED FRAME OF THE INNER UPRIGHT WALL STRUCTURE 17 TO THE SUPPORTING PLATFORM 20 (FIG. 6)

As shown in FIGS. 3 and 4, the body of the supporting platform 20 has a series of generally parallel and laterally spaced and transversely extending reinforcing and supporting ribs 39 formed integrally therewith on the bottom surface thereof and extending transversely and downwardly between the inner supporting wall structures 40 and 41 of the supporting platform 20, which will be described hereinafter.

As shown in FIGS. 3, 4 and 6, the supporting platform 20 has a pair of generally parallel laterally spaced inner and outer marginal or peripheral side and end wall supporting structures 40 and 41, respectively, formed integrally therewith adjacent the outer marginal or peripheral edge portions of the body of the supporting platform 20 and extending therebelow.

As shown in FIG. 6, the inner side and end wall supporting structure 40 has an enlarged and generally U-shaped upper end or head portion 42 formed thereon and an upwardly facing sealing groove 43 is formed therein. As is also shown in FIG. 6, each of the side and end walls 27 of the frame of the inner upright wall structure 17 has a downwardly extending lower end portion in the form of a sealing tongue 44 formed thereon which projects into the sealing groove 43, thereby providing a tongue and groove sealing construction 44–43 between the side walls 27 and end walls 28 of the frame of the inner upright wall structure 17 and the inner supporting wall structure 40 of the supporting platform 20. To complete this sealing construction, a suitable and conventional plastic sealant material 45 is arranged in the sealing groove 43 to provide an hermetic water-resistant seal between the sealing groove 43 and the sealing tongue 44 (FIG. 6).

The inner side and end walls supporting structure 40 of the supporting platform 20 has an outwardly and generally horizontally extending flange member 46 formed thereon, and the flange member 46 extends laterally outwardly somewhat below the body of the inner supporting wall structure 49, as shown in FIG. 6.

The flange member 46 has a laterally outwardly and downwardly extending flange portion 47 which is curved outwardly and downwardly and merges into and is integral with the upper edge portions of the outer supporting wall structure 41 of the supporting platform 20, as shown in FIG. 6.

An outwardly and generally horizontally extending flange member 48 is formed on and integrally with the lower end portion of each of the side walls 27 and end walls 28 of the frame of the inner upright wall structure and fastening elements in the form of headed screws 49 extend through openings 50 in the flange member 46 and into openings 51 in the flange member 48, thereby mechanically fastening the frame of the inner upright wall structure 17 to the inner supporting wall structure 40 of the supporting platform 20. As shown in FIG. 6, a suitable and conventional plastic sealant material 52 is arranged between the flange member 46 and 48 to provide an hermetic water-resistant seal between these parts.

THE MEANS FOR HERMETICALLY SEALING AND THE MEANS FOR MECHANICALLY FASTENING THE DOME-SHAPED OUTER COVER MEMBER 22 TO THE SUPPORTING PLATFORM (FIG. 6)

The downwardly extending and curved flange portion 47 of the flange member 46 has an upwardly and vertically extending marginal or peripheral supporting rib 53 formed integrally therewith, adjacent its outer marginal or peripheral edge portion, and this supporting rib 53 cooperates with the flanges 46–47 and 48 to provide a sealing groove 61 into which a downwardly extending sealing tongue 54 on the side walls 23 and end walls 24 of the dome-shaped outer cover member 22 projects, thereby providing a tongue and groove sealing construction 54-53 between the dome-shaped outer cover member 22 and the outer wall structure 41 of the supporting platform 20; this sealing construction being completed by a suitable and conventional plastic sealant material 55 which is arranged in the sealing groove 53 to provide an hermetic water-resistant seal therein.

The upwardly extending supporting rib 53 on the flange portion 47 projects into a marginal or peripheral groove 56 which is formed in an outwardly extending flange 57 which is formed on each of the side walls 23 and end walls 24 of the dome-shaped outer cover member 22 so that the dome-shaped outer cover member 22 rests, in part, on the supporting ribs 53 (FIG. 6).

The dome-shaped outer cover member 22 is mechanically fastened to the outer supporting wall structure 41 of the supporting platform 20 by means of fastening elements in the form of headed screws 58 which are extended, at a downwardly inclined angle, through openings 59 which are formed in a tapered shoulder portion 62 which is formed in the side walls 23 and end walls 24 of the dome-shaped outer cover 22 and into openings 60 in the outer supporting wall structure 41 of the supporting platform 20 (FIG. 6), and in this manner the dome-shaped outer cover member 22 is hermetically sealed and mechanically fastened to the outer supporting wall structure 41 of the supporting platform 20.

THE DECORATIVE COLORED PANELS ON THE OUTER SURFACES OF THE SIDE AND END WALLS 23 AND 24 OF THE DOME-SHAPED OUTER COVER MEMBER 22 (FIGS. 1 AND 8)

The new burial vault 15 comprises a novel construction and arrangement of decorative geometrically-shaped colored molded plastic resinous panels which are adhesively mounted in correspondingly geometrically-shaped recesses in the outer surfaces of the side walls 23 and end walls 24, respectively, of the dome-shaped outer cover member 22. This construction and arrangement are provided by suitably geometrically shaped recesses 63 which are formed in the outer surfaces of the side and end walls 23 and 24, respectively, of the dome-shaped outer cover member 22 and into which correspondingly geometrically shaped colored molded plastic resinous panels 64 are arranged and are held in the recesses 63 by means of a suitable adhesive 65 (FIG. 8), thus enhancing the decorative, ornamental and aesthetic appearance and appeal of the new burial vault 15.

THE ASSEMBLY OF THE COMPONENT PARTS OF THE NEW BURIAL VAULT 15

When the new burial vault 15 is used in the funeral and burial vault period or system, as disclosed in applicant's copending application, hereinbefore referred to, the assembly of the component parts of the new burial vault 15, is as follows:

The inner upright wall structure 17 is assembled on and over the supporting platform 20 and is hermetically sealed thereto, as at 43–44–45, and is mechanically fastened to the inner wall structure 40 of the supporting platform 20 by means of the fastening elements 49, as shown in FIG. 6, and as hereinbefore described. In the funeral and burial method or system referred to above, the inner upright wall structure 17, as thus fastened to the supporting platform 20, is used as a part of a simulated casket unit or arrangement during visitation at the funeral home and the remains of the deceased are positioned within the inner upright wall structure 17 and suitably positioned therein by means of an adjustable bed of foam, or the like, with suitable decorative draping arranged over the walls of the inner upright wall structure 17.

In the use of the new burial vault 17 in the funeral and burial method or system referred to above, at the conclusion of the visitation service at the funeral home, the decorative draping is arranged inside the inner upright wall structure 17. The closure plate or lid member 21 is then arranged over the frame of the inner upright wall structure 17 and is hermetically sealed thereto, as at 37, with the upper marginal or peripheral edge portions 36 of the side walls 27 and end walls 28 of the frame of the inner upright wall structure 17 projecting into the marginal or peripheral groove 35 which is formed in the enlarged head portion 34 of the closure plate or lid member 21, as shown in FIG. 7, and as hereinbefore described.

The inner upright wall structure 17, and the supporting platform 20, with other parts of the simulated casket unit (not shown), with the remains of the deceased therein, are then carried or transported to the cemetery (by means not shown), for a grave side or other cemetery service, whereupon the other parts of the simulated casket unit or arrangement (not shown) are removed from the assembled inner upright wall structure 17, supporting platform 20, and closure plate or lid member 21, and the aforesaid other parts of the simulated casket unit or arrangement are returned to the funeral home for reuse.

The dome-shaped outer cover member 22 is then arranged over the assembled supporting platform 20, and over the frame of the inner upright wall structure 17, and over the closure plate or lid member 21, as shown in FIG. 6, and as described hereinbefore, and the dome-shaped outer cover member 22 is then hermetically sealed to the outer supporting wall structure 41 of the supporting platform 20, as at 54—51—55, and is mechanically fastened to the outer supporting wall structure 41 of the supporting platform 20 by means of the fastening elements in the form of the headed screws 60, as shown in FIG. 6, and as described hereinbefore, thereby completing the assembly of the parts of the burial vault 15 with the remains of the deceased arranged in the thus closed and hermetically sealed burial vault 15 for interment in the grave opening.

When the parts of the new burial vault 15 are thus assembled, the shoulders 38 of the internal reinforcing ribs 31 and 32 on the inner surfaces of the side and end walls 23 and 24, respectively, of the dome-shaped outer cover member 22 rest on the upper surface of the enlarged flange or head portion 34 of the closure plate member 21, thereby further firmly securing the dome-shaped outer cover member 22 upon the closure plate or lid member 21 and upon the frame of the inner upright wall structure 17, as shown in FIG. 7.

While the new burial vault 17 has thus been described as being particularly designed and adapted for use in the funeral and burial vault method or system which forms the subject matter of the applicant's above-mentioned copending application, and in which the inner upright wall structure 17 and attached supporting platform 20 form a part of a simulated casket unit, it will be understood that the new burial vault 15, and the inner upright wall structure 17 embodied therein, are not limited to such usage but may be used as a burial vault for enclosing a conventional casket with the remains of the deceased therein, and with the parts of the new burial vault assembled and hermetically sealed and mechanically fastened together, as hereinbefore described, for interment in a grave opening.

A burial vault is thus provided which is effectively hermetically sealed against penetration of water when in the grave opening; has relatively great structural strength and resistance to the crushing forces of the overlying weight of the earth when in the grave opening, and to the weight of cemetery machinery moving thereover; has relatively great resistance to the force of the hydrostatic pressure of ground water when in the grave opening; and also has an attractive decorative ornamental appearance and aesthetic appeal; and is adapted for use in the funeral and burial vault method or system hereinbefore referred to and also for use as a burial vault for the interment of the remains of a deceased person in a conventional casket.

It will thus be seen that the present invention provides a new and improved molded plastic resinous burial vault having the desirable advantages and characteristics and accomplishing its intended objects including those hereinbefore described and others which are inherent in the invention.

I claim:

1. A burial vault comprising:
   (a) a composite base including
      (1) a generally flat and rectangular-shaped supporting platform having
         a. an upper surface; and including
            1. a main body portion having
               (a) a generally horizontally extending marginal or peripheral flange extending outwardly therearound and having
               (b) a downwardly and generally vertically extending marginal or peripheral flange surrounding the said main body portion of the said generally flat and rectangular-shaped supporting platform
      (2) an inner upright wall structure having a generally rectangular-shaped frame resting on the said upper surface of the said generally horizontally extending marginal or peripheral flange portion of the said main body portion of the said supporting platform; and including
         a. generally vertically extending side walls; and
         b. generally vertically extending end walls;
         c. the said generally vertically extending side walls and end walls of the said inner upright wall structure having lower marginal or peripheral edge portions; and the said inner upright wall structure having d. an open upper end or top; and e. an open lower end; and including f. a generally horizontally extending marginal or peripheral flange portion extending around and laterally outwardly from the said lower marginal or peripheral edge portions of the side walls and end walls of the said inner upright wall structure;

(3) a generally flat and rectangular-shaped closure plate member arranged over and closing the said open upper end or top of the said generally rectangular-shaped frame of the said inner upright wall structure;

(b) a dome-shaped outer cover member arranged over and enclosing the said inner upright wall structure and the said supporting platform; and including (1) generally vertically extending side walls and end walls and the said side walls and end walls of the said dome-shaped outer cover member having a. lower and downwardly extending marginal or peripheral edge portions extending below and outwardly of the said main body portion of the said generally flat and rectangular-shaped supporting platform and outwardly of the said generally horizontally extending marginal or peripheral flange portion of the said inner upright wall structure and outwardly of the said downwardly and generally vertically extending marginal or peripheral flange of the said main body portion of the said generally flat and rectangular-shaped supporting platform;

(2) a closed top wall; and having (3) an open bottom;

(c) first sealing means for hermetically sealing the said generally rectangular-shaped frame of the said inner upright wall structure to the said generally flat and rectangular-shaped supporting platform;

(d) first fastening means for mechanically fastening the said generally horizontally extending marginal or peripheral flange portion of the said generally rectangular-shaped frame of the said inner upright wall structure to the said generally horizontally extending marginal or peripheral flange of the said generally flat and rectangular-shaped supporting platform;

(e) second sealing means for hermetically sealing the said dome-shaped outer cover member to the said generally flat and rectangular-shaped supporting platform;

(f) second fastening means for mechanically fastening the said lower and downwardly extending marginal or peripheral edge portions of the dome-shaped outer cover member to the said downwardly and generally vertically extending marginal or peripheral flange of the said main body of the said generally flat and rectangular-shaped supporting platform; the said generally rectangular-shaped frame of the said inner upright wall structure having (g) marginal or peripheral upper edge portions; the said closure plate member including (h) marginal or peripheral outer edge portions having formed thereon (1) an inverted and generally U-shaped marginal or peripheral flange having formed therein (2) a marginal or peripheral downwardly facing groove; and (i) the said marginal or peripheral upper edge portions of the said generally rectangular-shaped frame of the said inner upright wall structure extending into the said downwardly facing marginal or peripheral groove in the said inverted and generally U-shaped marginal or peripheral flange on the said closure plate member.

2. A burial vault as defined in claim 1 in which (a) the said first fastening means for mechanically fastening the said generally horizontally extending marginal or peripheral flange portion of the said generally rectangular-shaped frame of the said inner upright wall structure to the said generally horizontally extending marginal or peripheral flange of the said generally flat and rectangular-shaped supporting platform is in the form of (1) threaded fastening means extending through the said generally horizontally extending marginal or peripheral flange of the said generally flat and rectangular-shaped supporting platform into the said generally horizontally extending marginal or peripheral flange portion of the said generally rectangular-shaped frame of the said inner upright wall structure.

3. A burial vault as defined in claim 1 in which (a) the said threaded fastening means of the said first fastening means is in the form of (1) headed screw threaded fastening members extending upwardly from below the said generally horzontally extending marginal or peripheral flange of the said generally flat and rectangular-shaped supporting platform into the said generally horizontally extending marginal or peripheral flange portion of the said generally rectangular-shaped frame of the said inner upright wall structure.

4. A burial vault as defined in claim 1 in which (a) the said second fastening means for mechanically fastening the said lower and downwardly extending marginal or peripheral edge portions of the said dome-shaped outer cover member to the said downwardly and generally vertically extending marginal or peripheral flange of the said main body portion of the said generally flat and rectangular-shaped supporting platform is in the form of (1) threaded fastening means extending through the lower and downwardly extending marginal or peripheral edge portions of the said dome-shaped outer cover member into the said generally vertically extending marginal or peripheral flange of the said main body portion of the said generally flat and rectangular-shaped supporting platform.

5. A burial vault as defined in claim 4 in which (a) the said threaded fastening means of the said second fastening means is in the form of (1) headed screw threaded fastening members extending inwardly from the outer side of the said lower and downwardly extending marginal or peripheral edge portions of the said dome-shaped outer cover member into the said downwardly and vertically extending marginal or peripheral flange of the said main body portion of the said generally flat and rectangular-shaped supporting platform.

6. A burial vault as defined in claim 1 in which
(a) the said side walls and the said end walls of the said generally rectangular-shaped frame of the said inner upright wall structure have
(1) generally vertically extending outer wall surfaces; and in which the said generally vertically extending outer wall surfaces of the said generally rectangular-shaped frame of the said inner upright wall structure have formed integrally thereon
(2) generally parallel and generally vertically extending spaced reinforcing ribs; and in which
(b) the said side walls and the said end walls of the said dome-shaped outer cover member have
(1) inner wall surfaces; and in which
(c) the said inner wall surfaces of the said dome-shaped outer cover member have formed integrally thereon
(1) generally parallel and generally vertically extending spaced reinforcing ribs.

7. A burial vault as defined in claim 6 in which
(a) each of the said generally parallel and generally vertically extending spaced reinforcing ribs on the said inner wall surfaces of the said dome-shaped cover member has formed therein
(1) a notched portion providing
(b) a generally horizontally extending shoulder; and in which the said generally flat and rectangular-shaped closure member has formed thereon
(1) marginal or peripheral edge portions; and in which
(c) the said marginal or peripheral edge portions of the said closure plate member project into the said notched portions and have the said shoulders resting thereon.

8. A burial vault as defined in claim 7 in which
(a) the said marginal or peripheral edge portions of the said closure plate member are generally U-shaped in form and include
(b) upper wall surfaces having the said shoulders resting thereon.

9. A burial vault as defined in claim 1 in which
(a) the said first sealing means for hermetically sealing the said generally rectangular-shaped frame of the said inner upright wall structure to the said generally flat and rectangular-shaped supporting platform includes
(1) an upwardly facing sealing groove formed in the said marginal or peripheral flange of the said generally flat and rectangular-shaped supporting platform; and
(2) a downwardly extending sealing tongue formed on the said lower marginal or peripheral edge portions of the said side walls and end walls of the said generally rectangular-shaped frame of the said inner upright wall structure and extending into the said upwardly facing sealing groove in the said marginal or peripheral flange of the said generally flat and rectangular-shaped supporting platform.

10. A burial vault as defined in claim 9 in which the said sealing means for hermetically sealing the said generally rectangular-shaped frame of the said inner upright wall structure to the said supporting platform includes
(a) a plastic sealing material in the said upwardly
(a) a plastic sealing material in the said upwardly facing sealing groove.

11. A burial vault as defined in claim 1 in which
(a) the said second sealing means for hermetically sealing the said dome-shaped outer cover member to the said supporting platform includes
(b) coacting sealing means on the said lower and downwardly extending marginal or peripheral edge portions of the said dome-shaped outer cover member and on the said generally horizontally extending marginal or peripheral flange of the said generally flat and rectangular-shaped supporting platform.

12. A burial vault as defined in claim 11 in which the said second and coacting sealing means includes
(a) an upwardly facing sealing groove formed in the said laterally and outwardly and generally horizontally extending marginal or peripheral flange on the said main body portion of the said generally flat and rectangular-shaped supporting platform; and
(b) a sealing tongue formed on and depending from the said lower marginal or peripheral edge portions of the said side walls and end walls of the said dome-shaped outer cover member and extending into the said upwardly facing sealing groove.

13. A burial vault as defined in claim 12 in which the said second and coacting sealing means includes
(a) a plastic sealant material arranged in the said upwardly facing sealing groove.

14. A burial vault as defined in claim 1, in which
(a) the downwardly and generally vertically extending marginal or peripheral flange surrounding the said main body of the supporting platform 20 is in the form of
(b) an outwardly and downwardly curved flange extending laterally outwardly and downwardly from the said main body portion of the said supporting platform and inwardly of the said lower and downwardly extending marginal or peripheral edge portions of the said side walls and end walls of the dome-shaped outer cover member.

15. A burial vault comprising:
(a) a composite base including
(1) a generally flat and rectangular-shaped supporting platform having
a. an upper surface; and including
1. a main body portion having
(a) a generally horizontally extending marginal or peripheral flange extending outwardly therearound and having
(b) a downwardly and generally vertically extending marginal or peripheral flange surrounding the said main body portion of the said generally flat and rectangular-shaped supporting platform;
(2) an inner upright wall structure having a generally rectangular-shaped frame resting on the said upper surface of the said generally horizontally extending marginal or peripheral flange portion of the said main body portion of the said supporting platform, and including
a. generally vertically extending side walls, and
b. generally vertically extending end walls,
c. the said generally vertically extending side walls and end walls of the said inner upright wall structure having lower marginal or peripheral edge portions; and the said inner upright wall structure having d. an open upper end or top; and e. an open lower end; and including f. a generally horizontally extending marginal or peripheral flange portion extending around and laterally outwardly from the said lower marginal or peripheral edge portions of the said side walls and end walls of the said inner upright wall structure;

(3) a generally flat and rectangular-shaped closure plate member arranged over and closing the said open upper end or top of the said generally rectangular-shaped frame of the said inner upright wall structure;

(b) a dome-shaped outer cover member arranged over and enclosing the said inner upright wall structure and the said supporting platform; and including (1) generally vertically extending side walls and end walls and the said side walls and end walls of the said dome-shaped outer cover member having a. lower and downwardly extending marginal or peripheral edge portions extending below and outwardly of the said main body portion of the said generally flat and rectangular-shaped supporting platform and outwardly of the said generally extending marginal or peripheral flange portion of the said inner upright wall structure and outwardly of the said downwardly and generally vertically extending marginal or peripheral flange of the said main body portion of the said generally flat and rectangular-shaped supporting platform;

(2) a closed top wall; and having (3) an open bottom;

(c) first sealing means for hermetically sealing the said generally rectangular-shaped frame of the said inner upright wall structure to the said generally flat and rectangular-shaped supporting platform;

(d) first fastening means for mechanically fastening the said generally horizontally extending marginal or peripheral flange portion of the said generally rectangular-shaped frame of the said inner upright wall structure to the said generally horizontally extending marginal or peripheral flange of the said generally flat and rectangular-shaped supporting platform;

(e) second sealing means for hermetically sealing the said dome-shaped outer cover member to the said generally flat and rectangular-shaped supporting platform;

(f) second fastening means for mechanically fastening the said lower and downwardly extending marginal or peripheral edge portions of the said dome-shaped outer cover member to the said downwardly and generally vertically extending marginal or peripheral flange of the said main body portion of the said generally flat and rectangular-shaped supporting platform; and (g) third sealing means for hermetically sealing the said generally flat and rectangular-shaped closure member to the said generally rectangular-shaped frame of the said inner wall structure to close the said open upper end or top thereof.

16. A burial vault comprising:

(a) a composite base including (1) a generally flat and rectangular-shaped platform having a. an upper surface; and including (1) a main body portion having (a) a generally horizontally extending marginal or peripheral flange extending outwardly therearound and having (b) a downwardly and generally vertically extending marginal or peripheral flange surrounding the said main body portion of the said generally flat and rectangular-shaped supporting platform;

(2) an inner upright wall structure having a generally rectangular-shaped frame and including a. generally vertically extending side walls and b. generally vertically extending end walls;

c. the said generally vertically extending side walls and end walls of the said inner upright wall structure having lower marginal or peripheral edge portions resting on the said upper surface of the said generally horizontally extending marginal or peripheral flange portion of the said main body portion of the said supporting platform; and the said inner upright wall structure having (d) first threaded fastening means for mechanically fastening the said generally horizontally extending marginal or peripheral flange portion of the said generally rectangular-shaped frame of the said inner upright wall structure to the said generally horizontally extending marginal or peripheral flange of the said generally flat and rectangular-shaped supporting platform;

(e) first sealing means for hermetically sealing the said generally rectangular-shaped frame of the said inner upright wall structure to the said generally flat and rectangulr-shaped supporting platform;

(f) second sealing means for hermetically sealing the said dome-shaped outer cover member to the said generally flat and rectangular-shaped supporting platform;

(g) second threaded fastening means for mechanically fastening the said lower and downwardly extending marginal or peripheral edge portions of the dome-shaped outer cover member to the said downwardly and generally vertically extending marginal or peripheral flange of the said main body portion of the generally flat and rectangular-shaped supporting platform; the said side walls and end walls of the said generally rectangular-shaped fame of the said inner upright wall structure having (h) marginal or peripheral upper edge portions; the said closure plate member including (f) marginal or peripheral outer edge portions resting on the said marginal or peripheral upper edge portions of the side walls and end walls of the said generally rectangular-shaped frame of the said inner upright wall structure; and (j) third sealing means for hermetically sealing the said marginal or peripheral outer edge portions of the said closure plate member to the said upper marginal or peripheral upper edge portions of the said side walls and end walls of the said inner upright wall structure.

* * * * *